US010587084B1

(12) United States Patent
Shen

(10) Patent No.: US 10,587,084 B1
(45) Date of Patent: Mar. 10, 2020

(54) MULTINATIONAL ADAPTER STRUCTURE

(71) Applicant: Su Chen Shen, New Taipei (TW)

(72) Inventor: Su Chen Shen, New Taipei (TW)

(73) Assignee: WONPRO CO., LTD., New Taipei (TW)

( * ) Notice: Subject to any disclaimer, the term of this patent is extended or adjusted under 35 U.S.C. 154(b) by 0 days.

(21) Appl. No.: 16/178,252

(22) Filed: Nov. 1, 2018

(51) Int. Cl.
*H01R 31/06* (2006.01)
*H01R 13/35* (2006.01)

(52) U.S. Cl.
CPC ..... *H01R 31/06* (2013.01); *H01R 13/35* (2013.01)

(58) Field of Classification Search
CPC ..... H01R 29/00; H01R 27/00; H01R 31/06; H01R 13/652; H01R 13/35
USPC ..... 439/166, 170–175, 104
See application file for complete search history.

(56) References Cited

U.S. PATENT DOCUMENTS 4,626,052 A * 12/1986 Rumble ..... H01R 31/06 439/173
5,213,516 A * 5/1993 Okamoto ..... H01R 13/652 439/104
6,790,062 B1 * 9/2004 Liao ..... H01R 13/72 439/171
7,220,139 B1 * 5/2007 Chang ..... H01R 31/06 439/172
2004/0038572 A1 * 2/2004 Liu ..... H01R 31/06 439/172
2004/0253854 A1 * 12/2004 Lee ..... H01R 31/06 439/106
2006/0110963 A1 * 5/2006 Cheng ..... H01R 13/6675 439/171
2007/0293072 A1 * 12/2007 Honton ..... H01R 27/00 439/159
2009/0298325 A1 * 12/2009 Jonker ..... H01R 13/60 439/501
2010/0311261 A1 * 12/2010 Lee ..... H01R 27/00 439/223
2014/0199867 A1 * 7/2014 Rogers ..... H01R 27/00 439/173
2018/0337501 A1 * 11/2018 Cai ..... H01R 27/00

* cited by examiner

*Primary Examiner* — Gary F Paumen
(74) *Attorney, Agent, or Firm* — Che-Yang Chen; Law Offices of Scott Warmuth

(57) ABSTRACT

The present invention provides a multinational adapter structure comprising a front cover, a main body, and aback cover. The front cover has a first through-hole and a second through-hole. The main body is provided with a press assembly, a first electrical connection assembly, and a second electrical connection assembly. At least one elastic member is provided between the press assembly and the main body. The first electrical connection assembly and the second electrical connection assembly respectively having a first conductive member and a second conductive member are disposed on the press assembly. The back cover is assembled on one side of the front cover, and the main body is enclosed by the back cover and the front cover. Through pushing the press assembly, the first electrical connection assembly or the second electrical connection assembly can be moved in a distance to accommodate with different national standards of various countries.

9 Claims, 16 Drawing Sheets

MULTINATIONAL ADAPTER STRUCTURE

BACKGROUND OF THE INVENTION

1. Technical Field

The present invention relates to an adapter, and in particular, to a multinational adapter structure which is portable, of high security and can be conveniently operated to conform to various plugs standard specification of different countries.

2. Background Art

With the continuous development of social economy, people travel abroad or go on a business trip abroad and the like more and more frequently. Hence, they need to take along with certain communication equipment or electrical devices such as notebook computers, mobile phones, MP3, household appliances and other electronic products. Due to the presence of difference in various sockets specifications of US, UK, Australian, and European and the like, the portable electronic products may not be used when moved to another country. Therefore, a multinational adapter is needed on a trip abroad. People are rather reluctant to use the conventional adapters due to their large sizes and inconvenience in operation. Further, the electrical pin sets of many power adapters are stored in a folded manner nowadays. In order to facilitate screwing out of the electrical pins, the electrical pin group still is designed as of which a partial is exposed. However, some of the exposed portions are prone to collision and deformation problems. Or, moreover, in order to conform to various socket specifications having different hole positions, disassembling the power adapter to adjust the electrical pin group is often to be necessary, and thereby causing inconvenience in operation and use.

More particularly, the power adapter, being a conductive device, may cause safety concerns in the case of incorrect operation or collision deformation.

Therefore, the pre sent invention is directed to solve the aforementioned deficiencies.

SUMMARY OF THE INVENTION

In view of the above, to effectively solve the above problems, the main objective of the present invention is to provide a multinational adapter structure which is portable, of high security and can be conveniently operated to conform to various plugs specification of different countries and.

To achieve the above objective, the present invention provides a multinational adapter structure, which includes a front cover, a main body, and a back cover. The front cover is formed with at least one first through-hole and at least one second through-hole which penetrate the front cover. The main body is provided on one side of the front cover. A press assembly, a first electrical connection assembly, and a second electrical connection assembly are provided above the main body. An electrical conduction assembly is provided on one side of the main body. At least one elastic member is provided between the press assembly and the main body. One end of the elastic member contacts the main body, and the other end of the elastic member contacts the press assembly. At least one first supporting member and at least one second supporting member are formed on sides of the press assembly opposite to the first electrical connection assembly and the second electrical connection assembly.

The first electrical connection assembly is disposed on the first supporting member and has a first pushing member, at least one first conductive member, and at least one first conductive piece. The second electrical connection assembly is disposed on the second supporting member and has a second pushing member and at least one second conductive member. The back cover is assembled on one side of the front cover, and the main body is enclosed by the back cover and the front cover. Therefore, the press assembly can be pressed to release the first electrical connection assembly or the second electrical connection assembly, and the first electrical connection assembly or the second electrical connection assembly can be selectively moved to conform to different national specifications, such that the first conductive member or the second conductive member of the first electrical connection assembly or the second electrical connection assembly passes through and protrudes from the front cover to achieve conduction by electrical connection. In this way, the adapter can be conveniently operated to conform to various plugs specification of different countries, and it is portable and of high security.

DETAILED DESCRIPTION OF THE PREFERRED EMBODIMENTS

Figure 1:
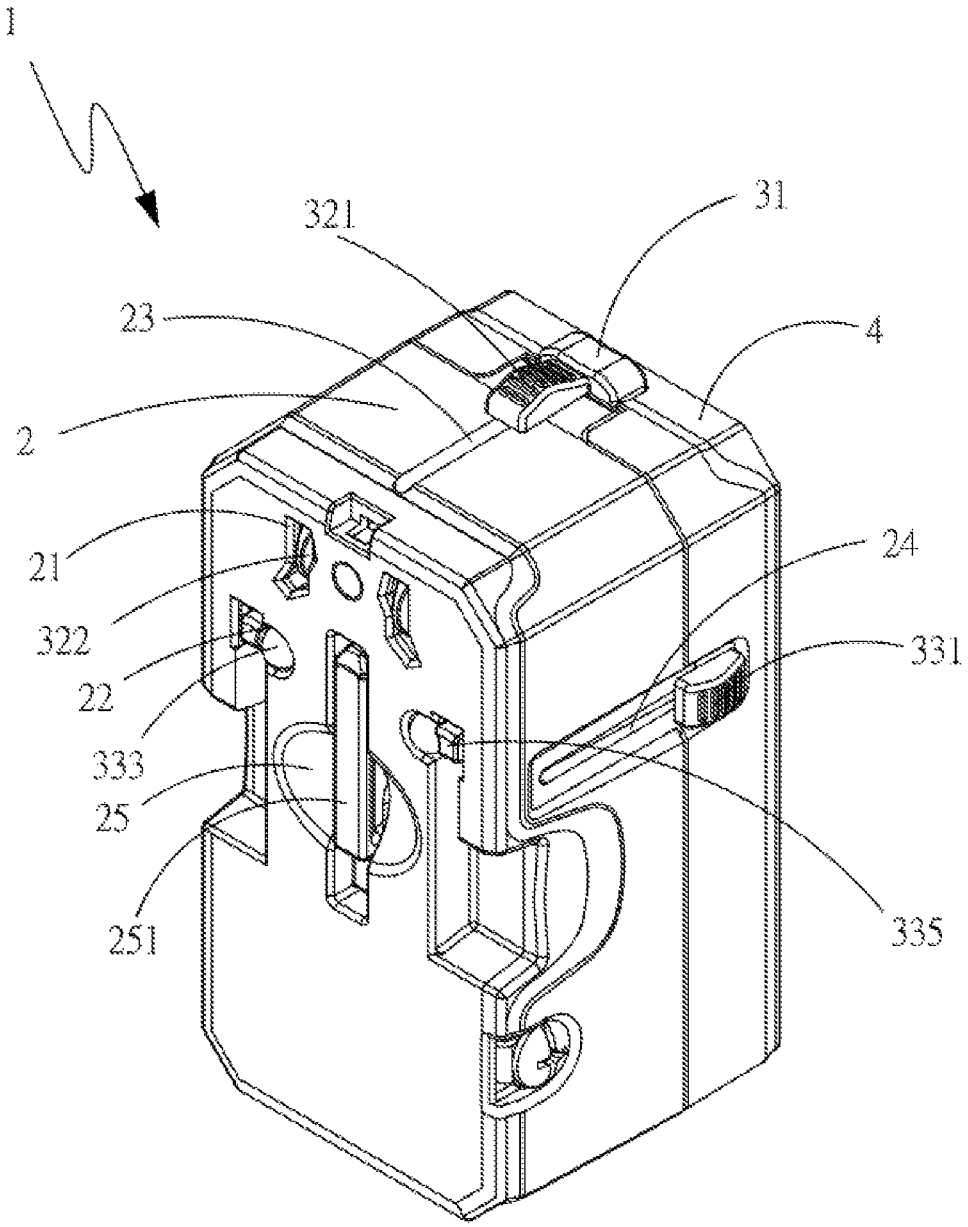
FIG. 1 is a schematic three-dimensional assembled diagram of a preferred embodiment of the present invention.
Figure 2:
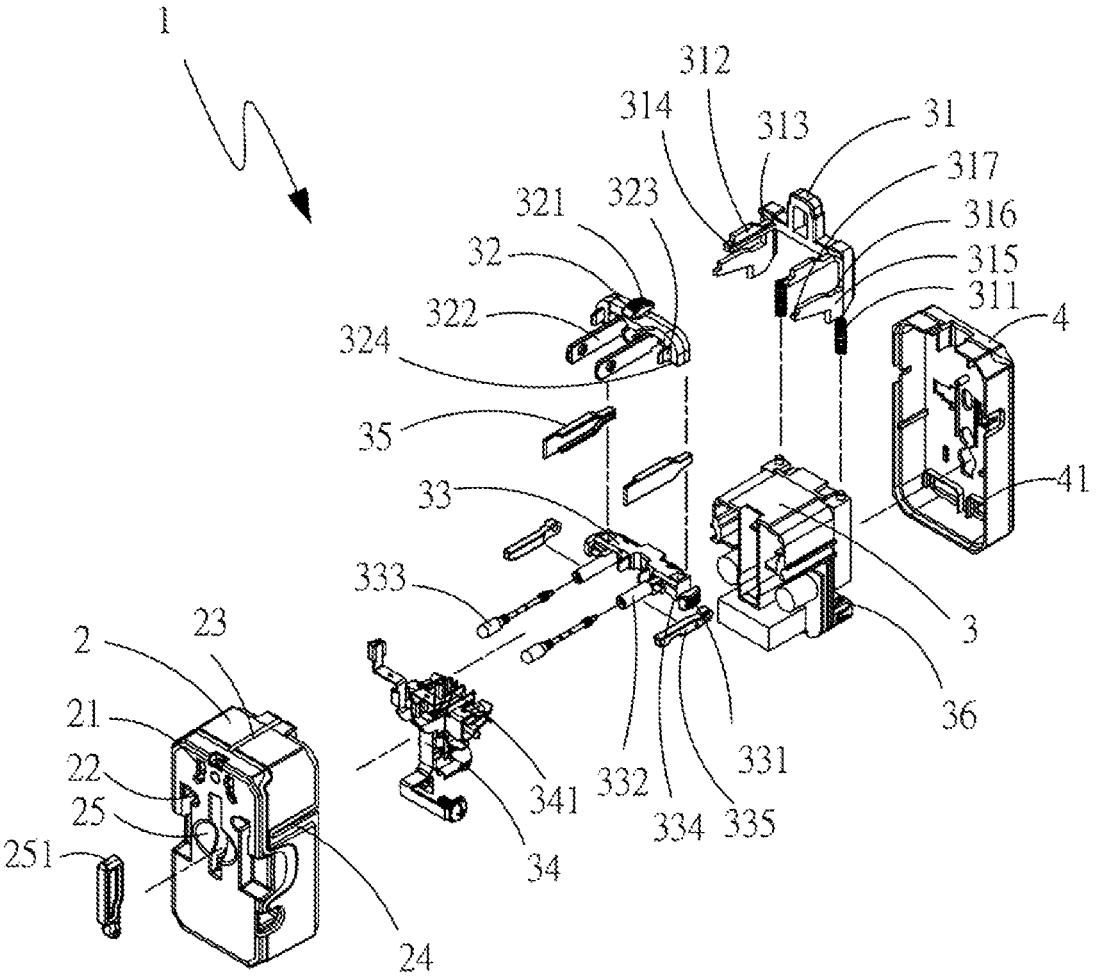
FIG. 2 is a schematic three-dimensional exploded diagram of a preferred embodiment of the present invention.
Figure 3:
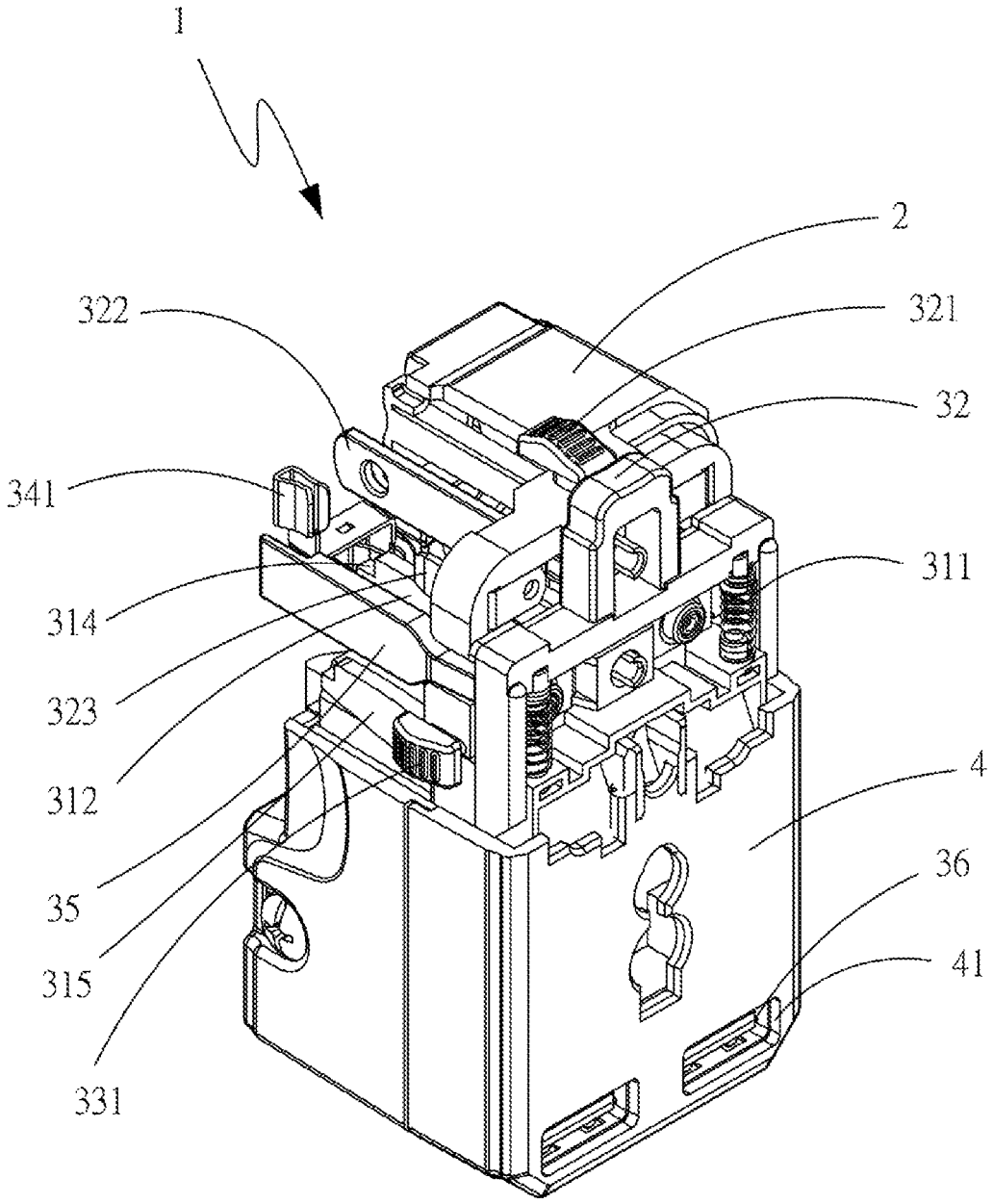
FIG. 3 is a schematic partial cross-sectional diagram from another perspective of a preferred embodiment of the present invention.
Figure 4:
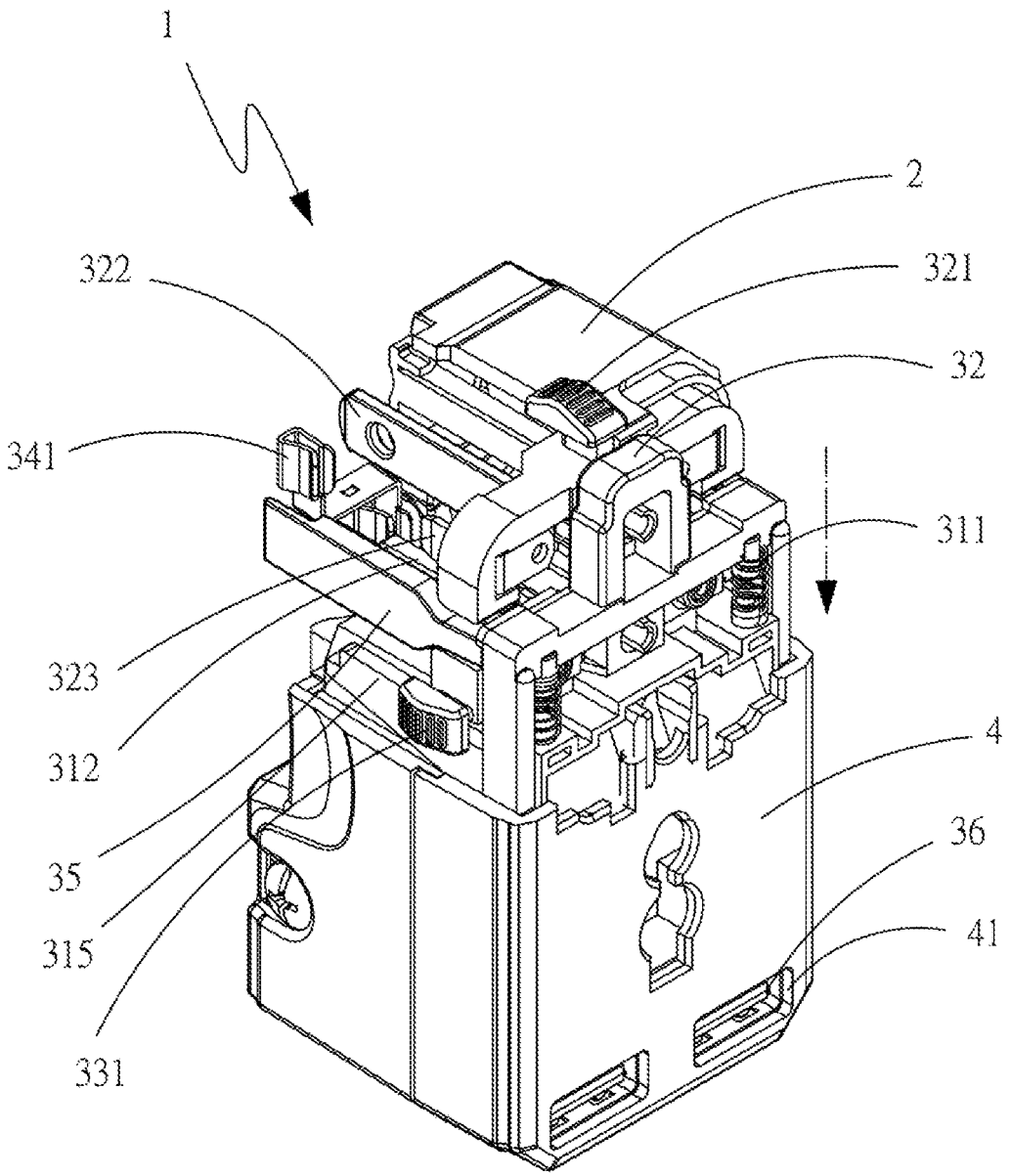
FIG. 4 is a schematic diagram illustrating the implementation of a press assembly in the present invention.
Figure 5:
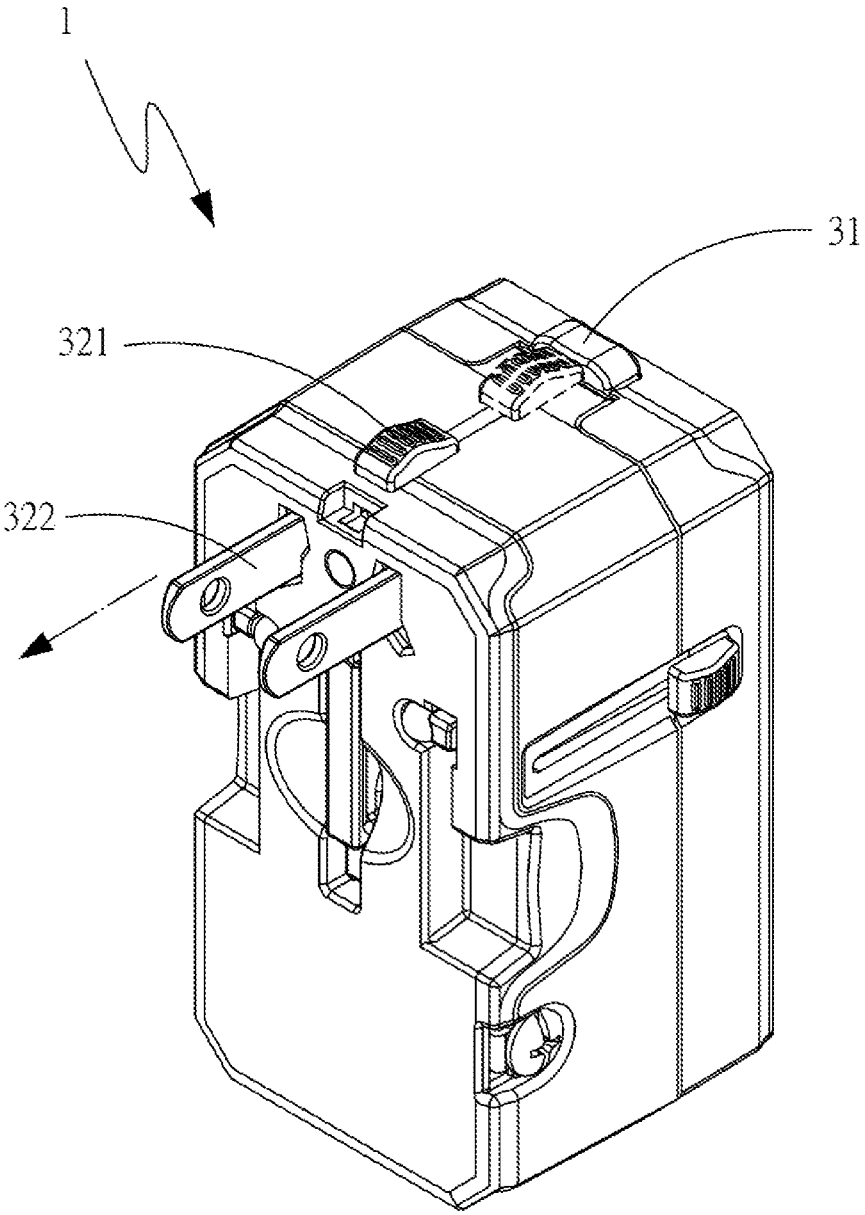
FIG. 5 is a first schematic diagram illustrating the implementation of a first electrical connection assembly in the present invention.
Figure 6:
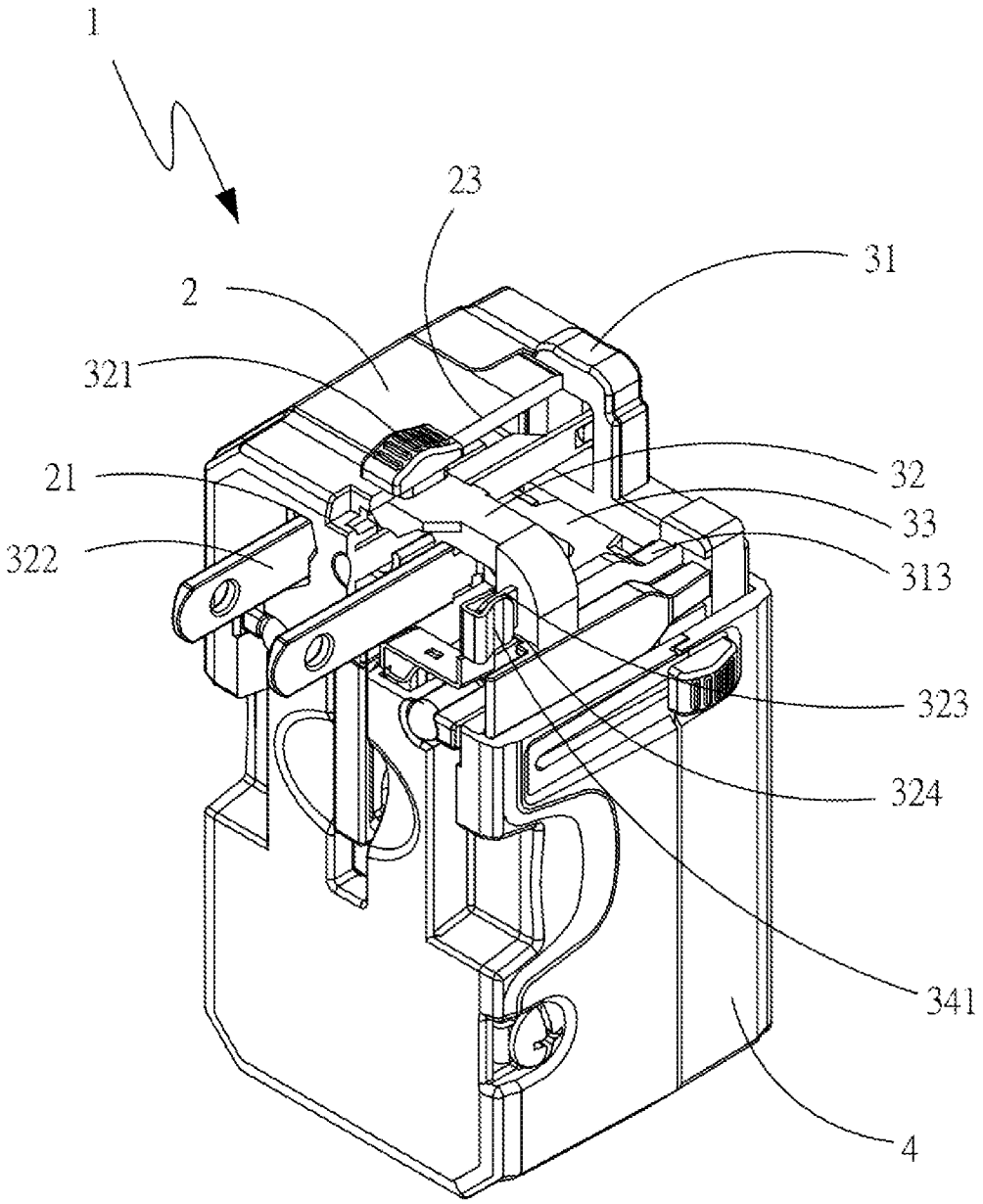
FIG. 6 is a first schematic partial cross-sectional diagram illustrating the implementation of the first electrical connection assembly in the present invention.
Figure 7:
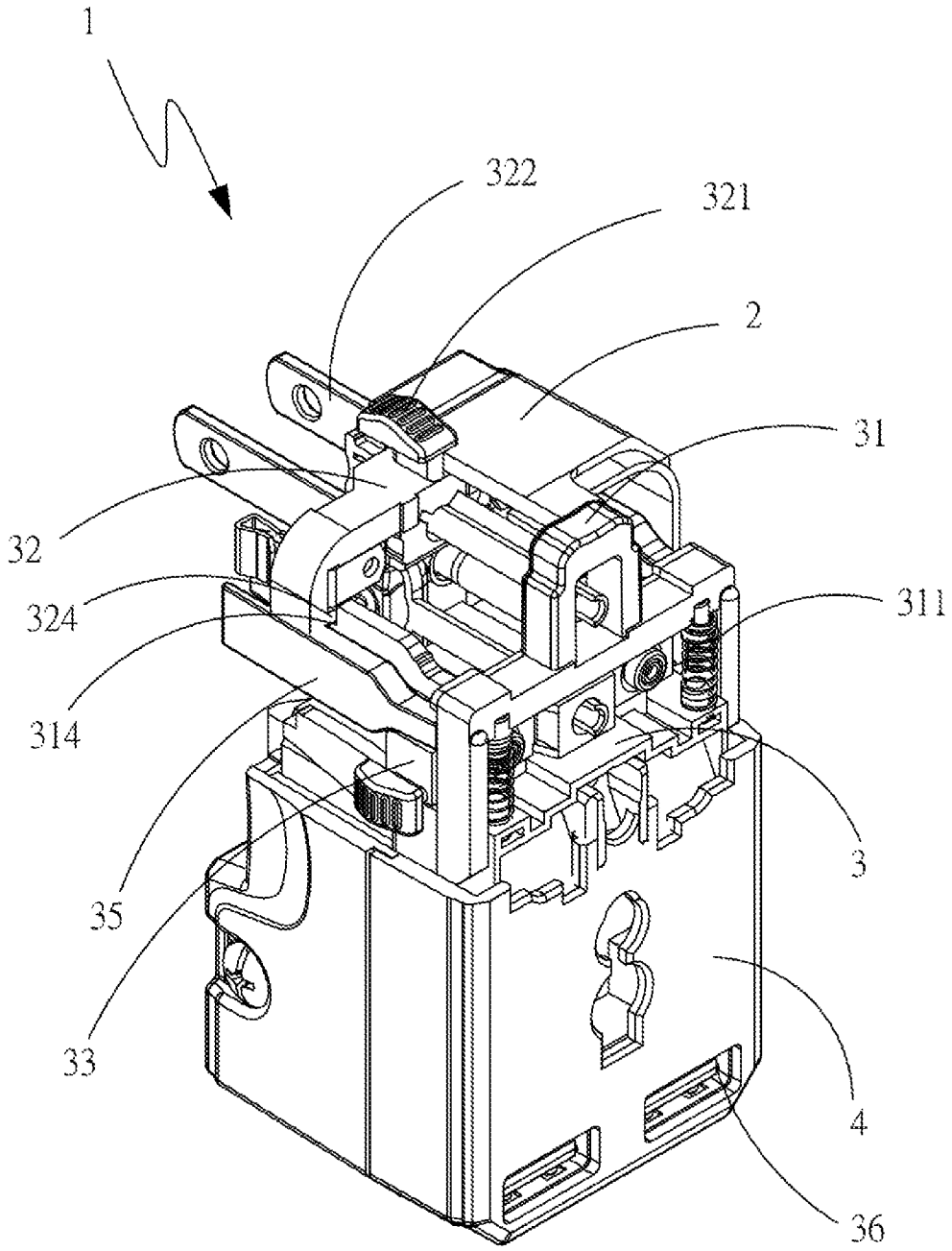
FIG. 7 is a schematic partial cross-sectional diagram illustrating the implementation of the first electrical connection assembly from another perspective in the present invention.

FIG. 1 to FIG. 3 are a schematic three-dimensional assembled diagram, a schematic three-dimensional exploded diagram, and a schematic partial cross-sectional diagram from another perspective of a preferred embodiment of the present invention. It can be clearly seen from FIG. 1 to FIG. 3 that, the multinational adapter structure 1 includes a front cover 2, a main body 3, and a back cover 4. The front cover 2 is formed with at least one first through-hole 21 and at least one second through-hole 22 which penetrate the front cover 2. A first guide groove 23, a second guide groove 24, and an accommodating groove 25 are respectively formed on sides of the front cover 2. The first guide groove 23 and the second guide groove 24 are respectively formed on a top side and a lateral side of the front cover 2. The accommodating groove 25 is formed on a side surface of the front cover 2, and a front auxiliary insertion member 251 is provided in the accommodating groove 25.

Further, the main body 3 is provided on another side surface of the front cover 2 opposite to the accommodating groove 25. A press assembly 31, a first electrical connection assembly 32, and a second electrical connection assembly 33 are provided above the main body 3. An electrical conduction assembly 34 is provided on one side of the main body 3. At least one lateral stopping member 35 and at least one electrical connector 36 are respectively provided on a lateral side and a bottom side of the main body 3. At least one elastic member 311 is provided between the press assembly 31 and the main body 3. One end of the elastic member 311 contacts the main body 3, and the other end of the elastic member 311 contacts the press assembly 31.

Among them, at least one first supporting member 312 and at least one second supporting member 315 are provided on sides of the press assembly 31. The first supporting member 312 has a first front guide groove 313 and a first rear guide groove 314. The second supporting member 315 has a second front guide groove 316 and a second rear guide groove 317.

Further, the first electrical connection assembly 32 is disposed on the first supporting member 312 and has a first pushing member 321, at least one first conductive member 322, and at least one first conductive piece 323. The first pushing member 321 is correspondingly disposed on the first guide groove 23. At least one first urging portion 324 is provided on a lower side of the first electrical connection assembly 32. The first urging portion 324 is disposed in the first front guide groove 313.

Additionally, the second electrical connection assembly 33 is disposed on the second supporting member 315 and has a second pushing member 331 and at least one second conductive member 332. The second pushing member 331 is correspondingly disposed on the second guide groove 24. A second urging portion 334 is provided on a lower side of the second electrical connection assembly 33. The second urging portion 334 is disposed in the second front guide groove 316. At least one rear auxiliary insertion member 335 is further provided on the second electrical connection assembly 33. An extension conductive member 333 is provided on the second conductive member 332.

At least one conductive clamping member 341 is provided on the electrical conduction assembly 34. The electrical conduction assembly 34 is electrically connected to the electrical connector 36.

In addition, at least one connector through-hole 41 is provided on the back cover 4 and is connected to the electrical connector 36. The back cover 4 is assembled on one side of the front cover 2, and the main body 3 is enclosed by the back cover 4 and the front cover 2.

Please refer to FIGS. 4 to 7. FIG. 4 to FIG. 7 are respectively a schematic diagram illustrating the implementation of the press assembly, a first schematic diagram illustrating the implementation of the first electrical connection assembly, a first schematic partial cross-sectional diagram illustrating the implementation of the first electrical connection assembly, and a schematic partial cross-sectional diagram illustrating the implementation of the first electrical connection assembly from another perspective in the present invention. The multinational adapter structure 1 can be operated according to the specifications of different countries. If the multinational adapter structure 1 is to be used in the US, the press assembly 31 is pressed first to urge against the elastic member 311, and the first urging portion 324 of the first electrical connection assembly 32 departs from the first front guide groove 313, such that through pushing the first pushing member 321 to move on the first guide groove 23 in a displacement and accompanying with such displacement, the first electrical connection assembly 32 is enacted to move on the main body 3. The first conductive member 322 can pass through the first through-hole 21 and is joined with the first conductive piece 323 by using the conductive clamping member 341 for electrical connection. Meanwhile, the first urging portion 324 is moved into the first rear guide groove 314, the press assembly 31 is then released and is restored under the elastic force of the elastic member 311, and the first urging portion 324 is limited by the first rear guide groove 314, such that the first conductive member 322 fixedly protrudes from the front cover 2. In this way, the multinational adapter structure 1 can be used on a socket in US specification. Users can realize the objective of electrical connection through the electrical connector 36 of the back cover 4. In addition, in the present embodiment, once upon the first electrical connection assembly 32 is moved on the main body, the second electrical connection assembly 33 is limited by the lateral stopping member 35 and thus cannot be further moved.

Figure 8:
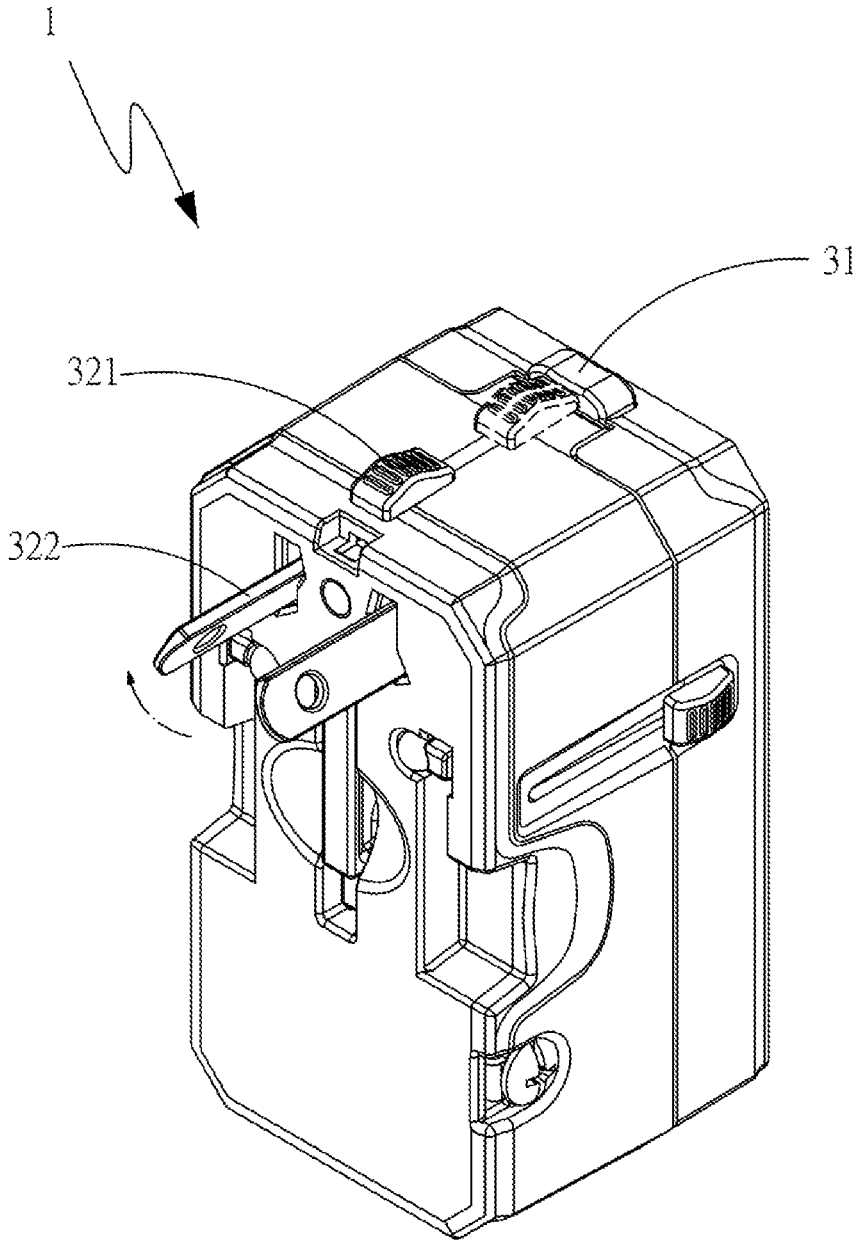
FIG. 8 is a second schematic diagram illustrating the implementation of the first electrical connection assembly in the present invention.
Figure 9:
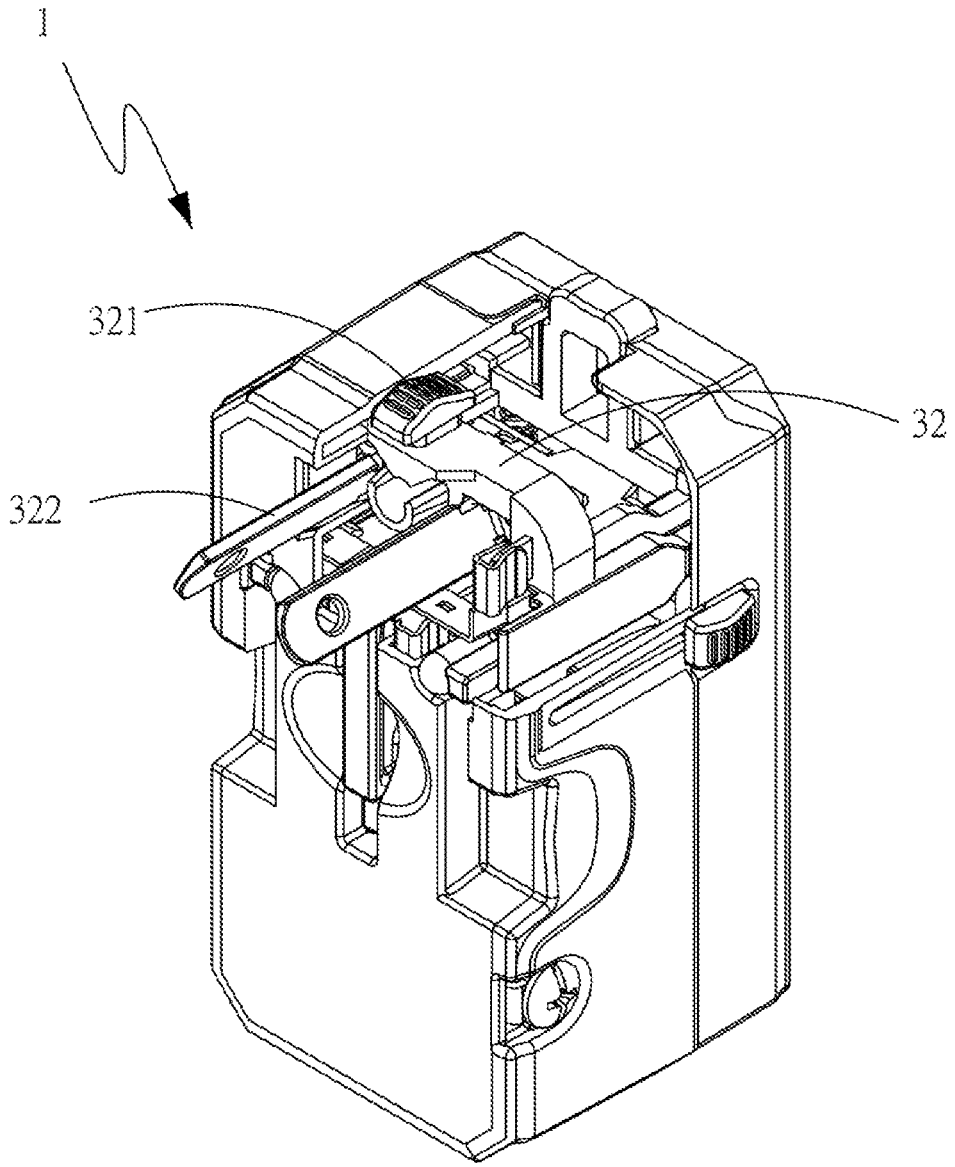
FIG. 9 is a second schematic partial cross-sectional diagram illustrating the implementation of the first electrical connection assembly in the present invention.
Figure 10:
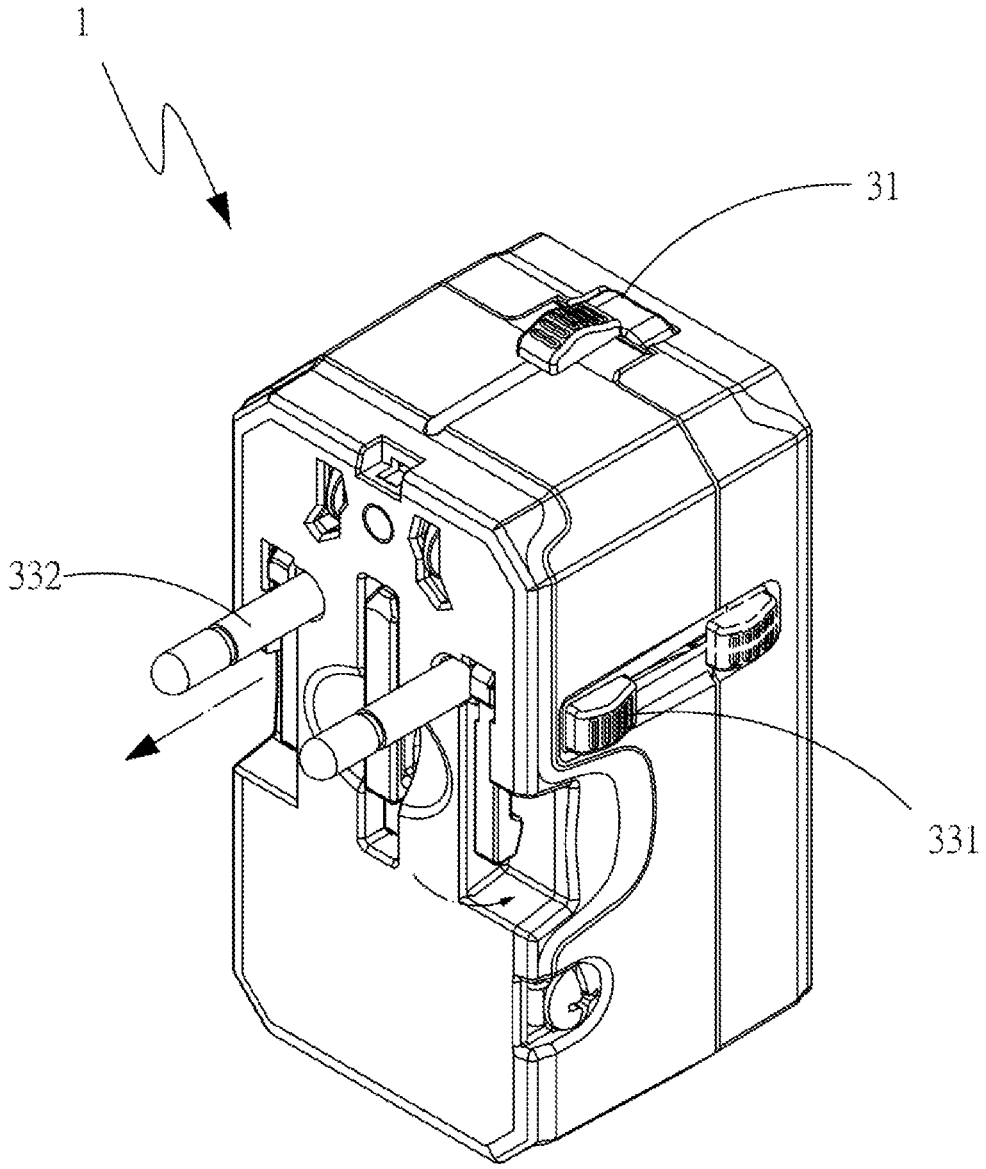
FIG. 10 is a first schematic diagram illustrating the implementation of a second electrical connection assembly in the present invention.
Figure 11:
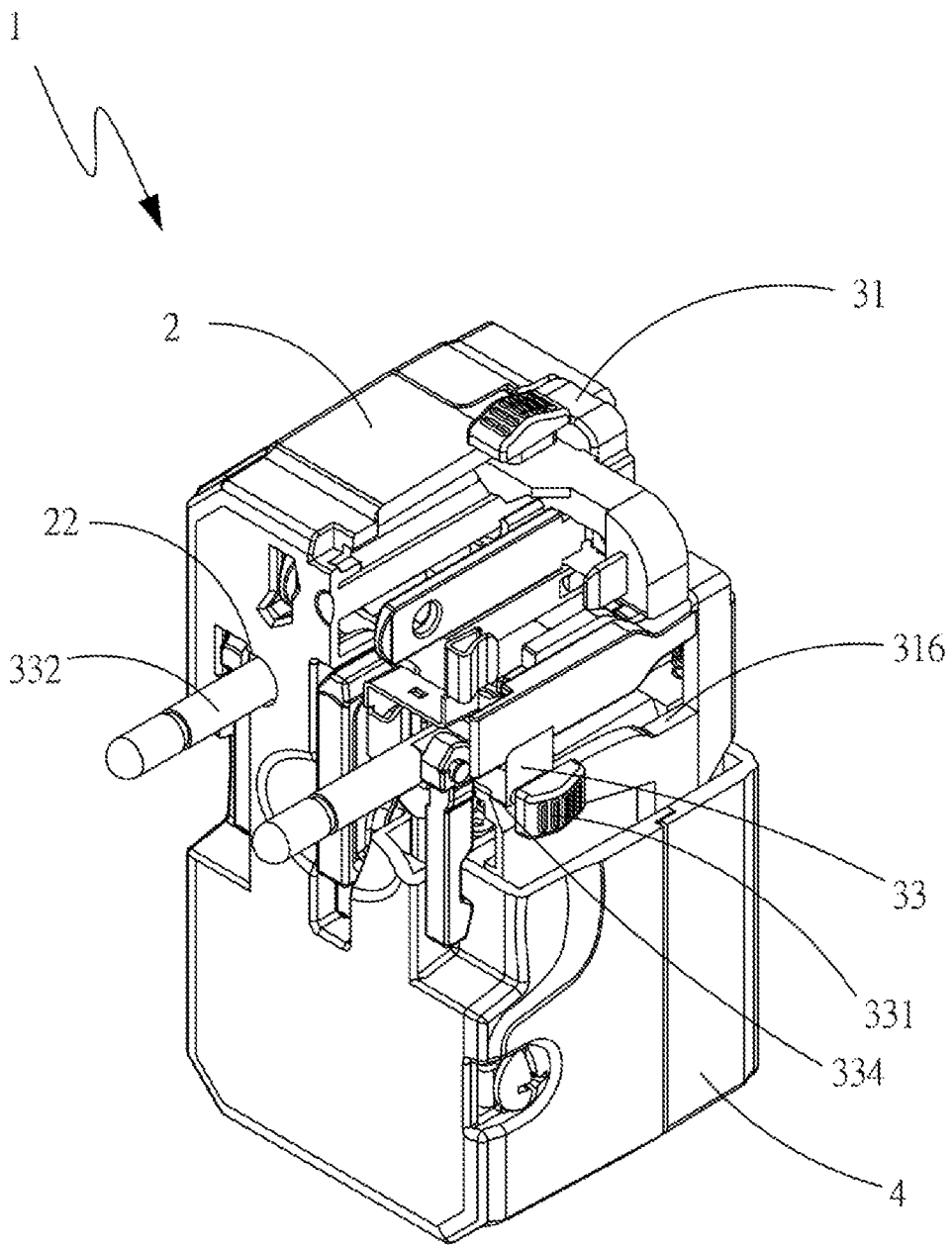
FIG. 11 is a first schematic partial cross-sectional diagram illustrating the implementation of the second electrical connection assembly in the present invention.
Figure 12:
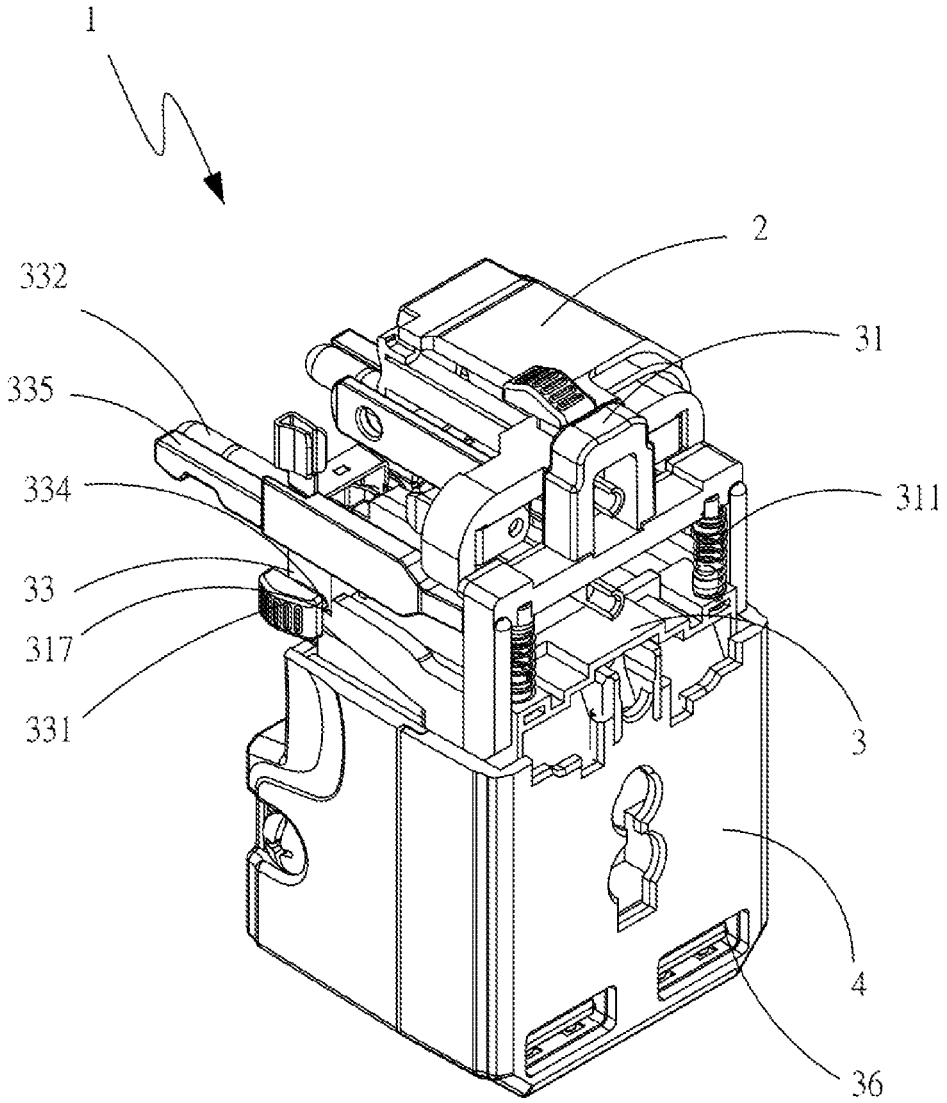
FIG. 12 is a first schematic partial cross-sectional diagram illustrating the implementation of the second electrical connection assembly from another perspective in the present invention.

Further, please refer to Figures above-mentioned and FIGS. 8 and 9. FIG. 8 and FIG. 9 are a second schematic diagram and a second schematic partial cross-sectional diagram respectively illustrating the implementation of the first electrical connection assembly in the present invention. In the case that the first conductive member 322 fixedly protrudes from the front cover 2, the first conductive member 322 can be rotated inward. Thereby, the two first conductive members 322 are inclined and presented as a Chinese character "八" having meaning of eight. In this way, through such inclination of the two first conductive members 322, the multinational adapter structure 1 can conform to the Australian socket specification in Australian (AU).

In addition, please refer to FIG. 4, and FIGS. 10 to 12. FIG. 4 and FIG. 10 to FIG. 12 are respectively a schematic diagram illustrating the implementation of the press assembly, a first schematic diagram illustrating the implementation of the second electrical connection assembly, and a first schematic partial cross-sectional diagram illustrating the implementation of the second electrical connection assembly from another perspective in the present invention. The multinational adapter structure 1 can be operated to conform to various sockets specifications of different countries. If the multinational adapter structure 1 is to be used in Switzerland, the press assembly 31 is pressed first to urge against the elastic member 311, and the second urging portion 334 of the second electrical connection assembly 33 departs from the second front guide groove 316, such that the second pushing member 331 can be pushed so as to be moved on the second guide groove 24 and cause a displacement of the second electrical connection assembly 33 on the main body 3. The second conductive member 332 can pass through the second through-hole 22, and meanwhile, the second urging portion 334 is moved into the second rear guide groove 317. The press assembly 31 is then released and is restored under the elastic force of the elastic member 311, and the second urging portion 334 is limited by the second rear guide groove 317, such that the second conductive member 332 fixedly protrudes from the front cover 2, and thus the multinational adapter structure 1 can be used on a Switzerland socket specification of Switzerland. Users can realize electrical connection through the electrical connector 36 of the back cover 4. In addition, in the present embodiment, once upon the first electrical connection assembly 33 is moved on the main body, the second electrical connection assembly 32 is limited by the lateral stopping member 35 and thus cannot be further moved.

Figure 13:
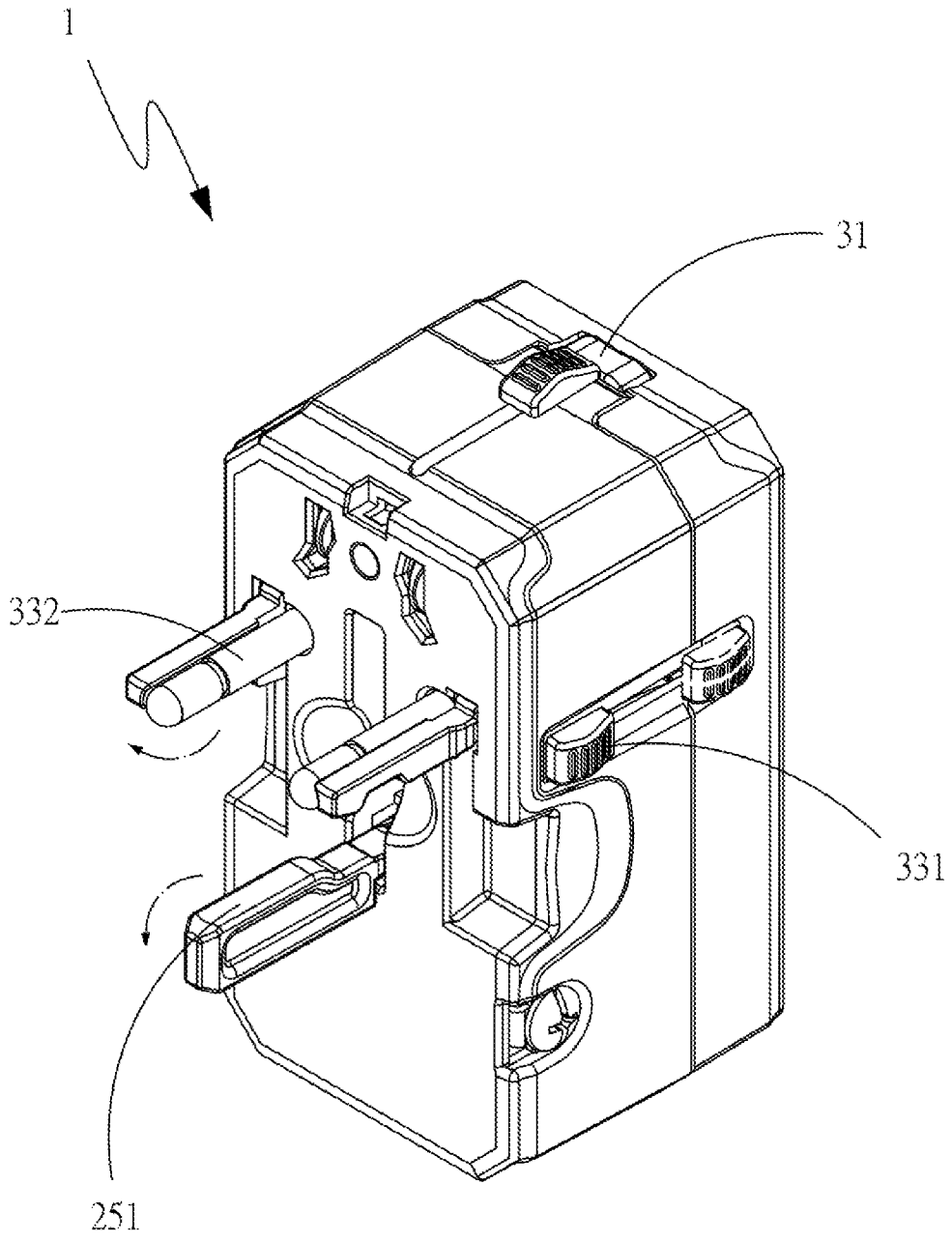
FIG. 13 is a second schematic diagram illustrating the implementation of the second electrical connection assembly in the present invention.
Figure 14:
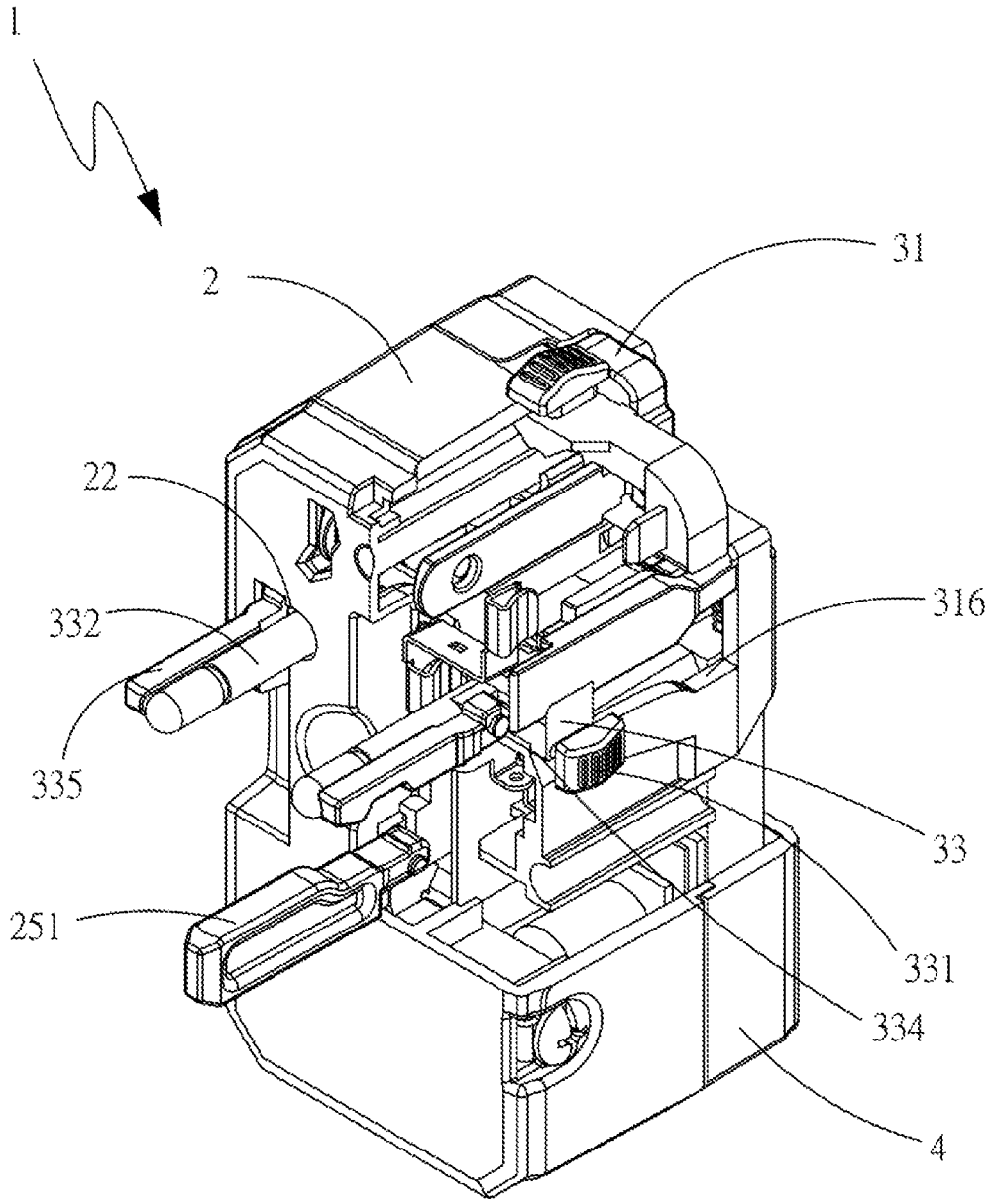
FIG. 14 is a second schematic partial cross-sectional diagram illustrating the implementation of the second electrical connection assembly in the present invention.

Further, please refer to Figures above-mentioned and FIGS. 13 and 14. FIG. 13 and FIG. 14 are a second schematic diagram and a second schematic partial cross-sectional diagram respectively illustrating the implementation of the second electrical connection assembly in the present invention. In the case that the second conductive member 332 and the rear auxiliary insertion member 335 fixedly protrude from the front cover 2, the upper end of the rear auxiliary insertion member 335 is put out to be a horizontal state, to the position of the second conductive member 332. Additionally, in the case that the second conductive member 332 and the rear auxiliary insertion member 335 fixedly protrude from the front cover 2, the upper end of the front auxiliary insertion member 251 provided in the accommodating groove 25 is then put out to be a horizontal state, and protruded from the front cover 2, and thus the multinational adapter structure 1 can conform to the UK sockets specification.

Figure 15:
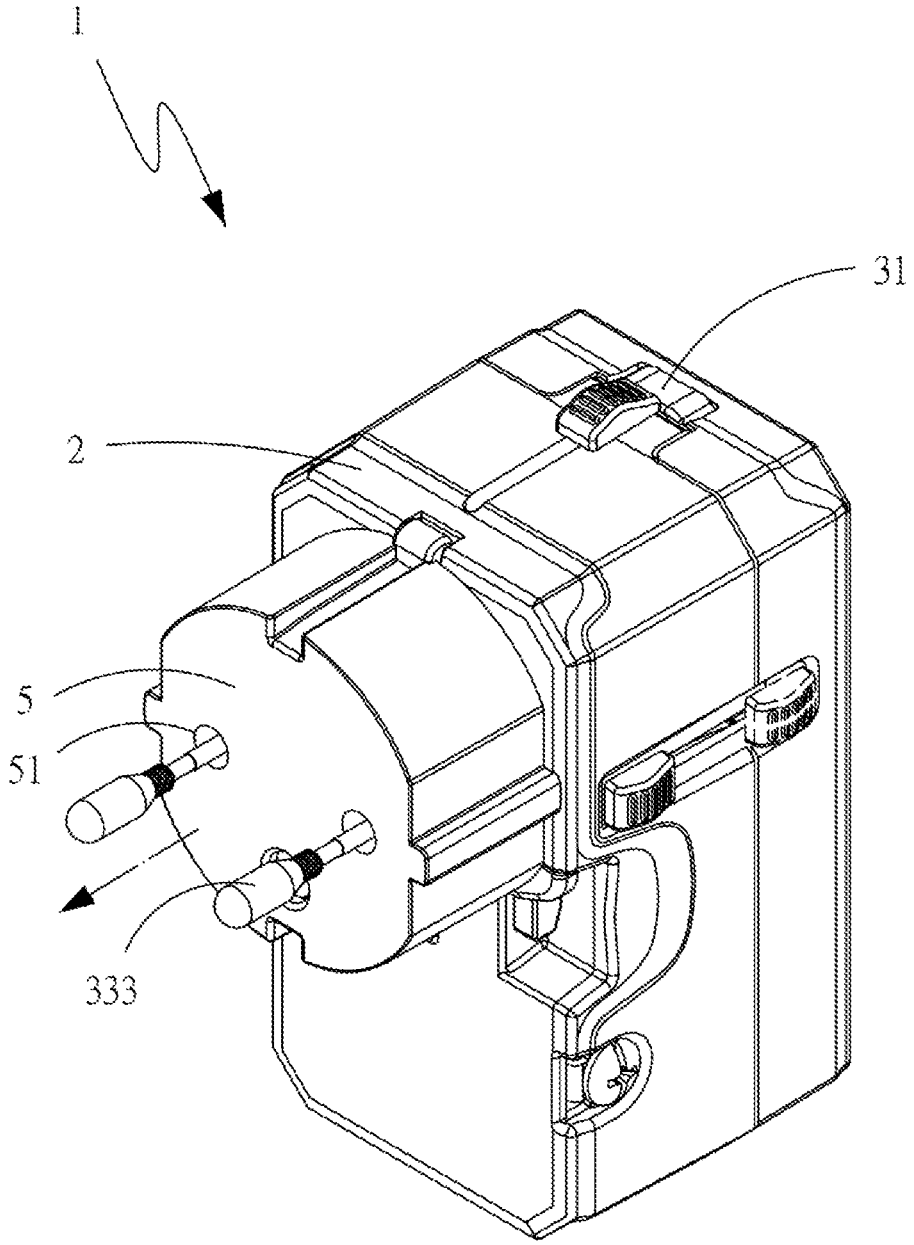
FIG. 15 is a third schematic diagram illustrating the implementation of the second electrical connection assembly of the present invention.
Figure 16:
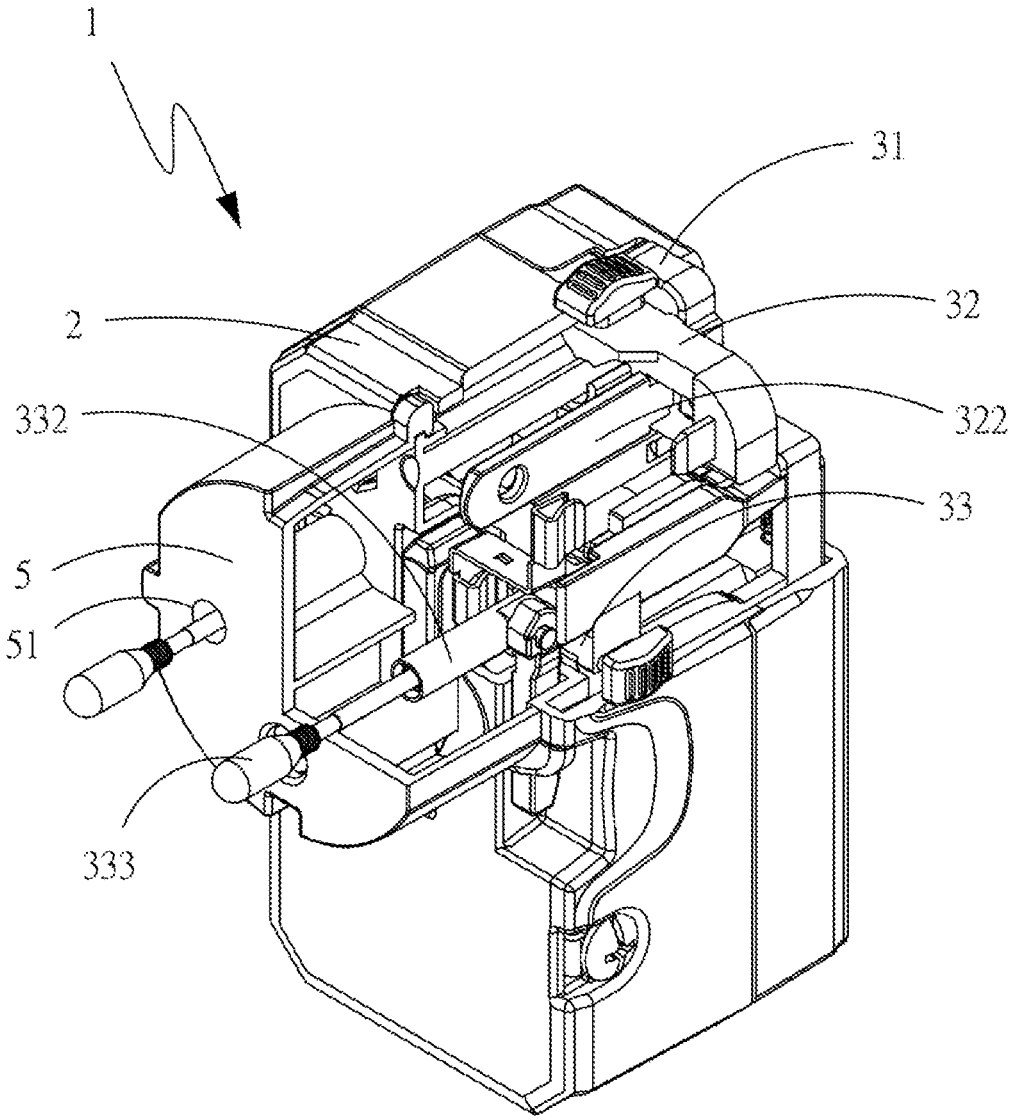
FIG. 16 is a third schematic partial cross-sectional diagram illustrating the implementation of the second electrical connection assembly in the present invention.

Further, please refer to FIGS. 15 and 16. FIG. 15 and FIG. 16 are a third schematic diagram and a third schematic partial cross-sectional diagram respectively illustrating the implementation of the second electrical connection assembly in the present invention. The multinational adapter structure 1 can be operated according to various sockets specifications of different countries. If the multinational adapter structure 1 is to be used in Germany, the second conductive member 332 fixedly protrudes from the front cover 2 and is then assembled with an adaption member 5. The adaption member 5 has at least one adaption through-hole 51. The second conductive member 332 is disposed in the adaption through-hole 51, and the extension conductive member 333 passes through the adaption through-hole 51 and protrudes from the adaption member 5. In this way, the multinational adapter structure 1 can be used on a Germany socket specification of German. Therefore, according to the multinational adapter structure 1, after the press assembly 31 is pressed, the first electrical connection assembly 32 or the second electrical connection assembly 33 is moved forwardly or backwardly a displacement under control, and the first conductive member 322 or the second conductive member 332 protrudes for electrical connection, such that the adapter can be conveniently operated to conform to various plugs specification in different countries and it is portable and of high security.

It should be noted that, the above descriptions are merely preferred embodiments of the present invention, and are not intended to limit the present invention. Changes can be made according to the concept of the present invention without departing from the spirit and scope of the present invention, for example, changes can be made to the structure or configuration of the invention. Such variations, modifications, applications and equivalent effects generated accordingly shall all fall within the protection scope of the present invention.

What is claimed is:

1. A multinational adapter structure, comprising:

a front cover, having at least one first through-hole and at least one second through-hole;

a main body, disposed on one side of the front cover and provided with a press assembly, a first electrical connection assembly, and a second electrical connection assembly, wherein at least one elastic member is provided between the press assembly and the main body, at least one first supporting member and at least one second supporting member are provided on sides of the press assembly, an electrical conduction assembly is provided on one side of the main body, the first electrical connection assembly is disposed on the first supporting member and has a first pushing member, at least one first conductive member, and at least one first conductive piece, the second electrical connection assembly is disposed on the second supporting member and has a second pushing member and at least one second conductive member, and the electrical conduction assembly is correspondingly disposed in the front cover; and a back cover, assembled on one side of the front cover, the main body being enclosed by the back cover and the front cover;

wherein a first guide groove, a second guide groove, and an accommodating groove are respectively formed on sides of the front cover, the first pushing member is correspondingly disposed on the first guide groove, the second pushing member is correspondingly disposed on the second guide groove, and a front auxiliary insertion member is provided in the accommodating groove;

wherein the first pushing member is capable of being moved a displacement on the first guide groove and causing a displacement of the first electrical connection assembly on the main body, and the first conductive member is capable of passing through the first through-hole and being joined with the first conductive piece by using at least one conductive clamping member of the electrical conduction assembly.

2. The multinational adapter structure according to claim 1, wherein the second pushing member is capable of being moved a displacement on the second guide groove and causing a displacement of the second electrical connection assembly on the main body, and the second conductive member is capable of passing through the second through-hole.

3. The multinational adapter structure according to claim 1, wherein the first supporting member has a first front guide groove and a first rear guide groove, at least one first urging portion is provided on a lower side of the first electrical connection assembly, and the first urging portion is disposed in the first front guide groove.

4. The multinational adapter structure according to claim 3, wherein the press assembly urges against the elastic member, the first urging portion departs from the first front guide groove, the first electrical connection assembly is moved on the main body, meanwhile the first urging portion is moved into the first rear guide groove, the elastic member is released, and the first urging portion is limited by the first rear guide groove.

5. The multinational adapter structure according to claim 2, wherein the second supporting member has a second front guide groove and a second rear guide groove, a second urging portion is provided on a lower side of the second electrical connection assembly, and the second urging portion is disposed in the second front guide groove.

6. The multinational adapter structure according to claim 5, wherein the press assembly urges against the elastic member, the second urging portion departs from the second front guide groove, the second electrical connection assembly is moved on the main body, meanwhile the second urging portion is moved into the second rear guide groove, the elastic member is released, and the second urging portion is limited by the second rear guide groove.

7. The multinational adapter structure according to claim 1, wherein at least one lateral stopping member is further provided on one side of the main body.

8. A multinational adapter structure, comprising:

a front cover, having at least one first through-hole and at least one second through-hole;

a main body, disposed on one side of the front cover and provided with a press assembly, a first electrical connection assembly, and a second electrical connection assembly, wherein at least one elastic member is provided between the press assembly and the main body, at least one first supporting member and at least one second supporting member are provided on sides of the press assembly, an electrical conduction assembly is provided on one side of the main body, the first electrical connection assembly is disposed on the first supporting member and has a first pushing member, at least one first conductive member, and at least one first conductive piece, the second electrical connection assembly is disposed on the second supporting member and has a second pushing member and at least one second conductive member, and the electrical conduction assembly is correspondingly disposed in the front cover; and a back cover, assembled on one side of the front cover, the main body being enclosed by the back cover and the front cover;

wherein the second electrical connection assembly is further provided with at least one rear auxiliary insertion member, and the second conductive member is further provided with an extension conductive member;

wherein an adaption member is provided on another side of the front cover opposite to the back cover, the adaption member has at least one adaption through-hole, the second conductive member is disposed in the adaption through-hole, and the extension conductive member passes through the adaption through-hole.

9. The multinational adapter structure according to claim 8, wherein the main body is provided with at least one electrical connector, the electrical connector is connected to at least one connector through-hole of the back cover, and the electrical connector is electrically connected to the electrical conduction assembly.

* * * * *